United States Patent [19]

McCarter

[11] Patent Number: 4,986,431

[45] Date of Patent: Jan. 22, 1991

[54] STORAGE TUBE ASSEMBLIES FOR ROLLED SHEETS

[76] Inventor: Mary Ann K. McCarter, 9801 Baseline Rd., Elverton, Calif. 95626

[21] Appl. No.: 257,328

[22] Filed: Oct. 13, 1988

[51] Int. Cl.[5] ..... B65D 1/30

[52] U.S. Cl. ..... 220/23.2; 206/446; 220/375; 220/507; 294/146; 294/159

[58] Field of Search ..... 220/23.2, 23.4, 23.83, 220/23.86, 21, 375, 356; 206/3, 446; 294/143, 146, 159, 160, 161, 162; 50/307, 904

[56] References Cited

U.S. PATENT DOCUMENTS

| | | | |
|---|---|---|---|
| 673,416 | 5/1901 | Booth | 40/307 |
| 2,446,155 | 7/1948 | Karle | 220/375 |
| 2,457,262 | 12/1948 | Norquist | 206/3 |
| 2,462,956 | 3/1949 | Gross | 220/23.4 |
| 2,585,602 | 2/1952 | Turner | 220/356 |
| 2,756,924 | 1/1956 | Abrahamson . | |
| 2,852,054 | 9/1958 | Motley | 40/307 |
| 3,164,185 | 1/1965 | Ingoldt | 294/146 |
| 3,756,497 | 9/1973 | Stewart . | |
| 3,866,646 | 2/1975 | Nevard | 294/159 |
| 4,154,274 | 5/1979 | Adamson | 294/159 |
| 4,334,373 | 6/1982 | Bryan . | |
| 4,366,641 | 1/1983 | Price | 220/21 |
| 4,467,917 | 8/1984 | Hayashi . | |
| 4,574,504 | 3/1986 | Holmer . | |
| 4,599,314 | 7/1986 | Shami | 294/160 |

*Primary Examiner*—George E. Lowrance
*Attorney, Agent, or Firm*—Bernhard Kreten

[57] ABSTRACT

This is a multi-tubular container for transporting, storing and securing materials such as rolled plans, blueprints, maps, charts, art work, or anything else one desires to deposit into a container which shields the contents from the elements and yet are readily accessible by authorized persons such as office personnel, building inspectors, foremen, or superintendentants of any building project.

The invention consists of an opted number of elongated, hollow, tubular receptacles that are assembled together by a connection process with two multi-encircling flat flange plates.

Closure of the two ends of each receptacle is facilitated by the use of snugly fitting caps or covers. The bottom cap shall be a permanent seal but still could be openable if one so desires. The top cap although snug may be pulled off easily by hand for convenient access to the contents. For field use, the removeable cover cap is attached to the tubal unit with an optional retainer line as not to be misplaced when unit is opened. A combination of tubes may be secured within the assembly by use of varied sizes and configurations of flanges making this container lightweight, secure and safe, convenient and simple and sorely needed in the engineering field.

This unit may be conveniently mounted on or in a work truck or set next to a desk in an office or in a boat for easy access by engineers, draftsmen, architects, plan checkers, sailors or anyone else involved with rolled plans, blueprints, maps, charts, or art work of any kind.

7 Claims, 2 Drawing Sheets

MARYANN McCARTER
SHEET 1 OF 2
FIG 1
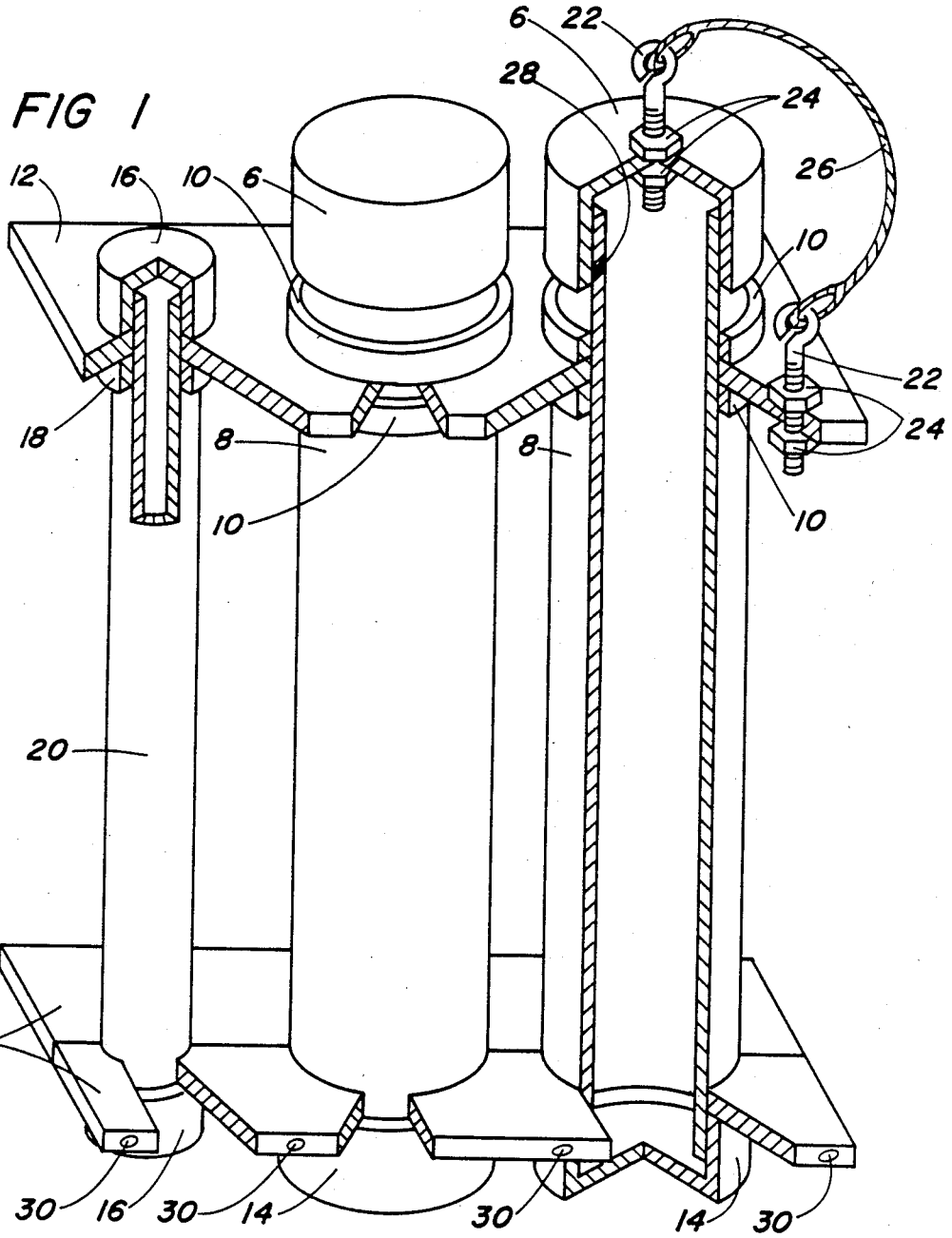
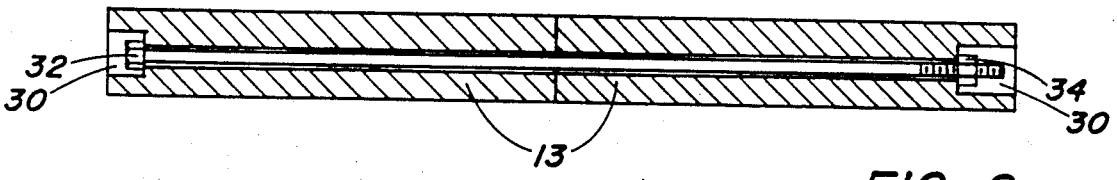
FIG 2

MARYANN McCARTER
SHEET 2 OF 2

STORAGE TUBE ASSEMBLIES FOR ROLLED SHEETS

BACKGROUND-FIELD OF INVENTION

This invention relates to storage tube assemblies, especially to portable storage tube assemblies for storing and protecting plan sheets or sets of plan sheets, maps, charts, art work or any item which may be easily deposited or withdrawn.

BACKGROUND-DESCRIPTION OF PRIOR ART

Many, if not most engineers, surveyors, contractors, construction inspectors and other professional people carry rolled plans or sets of rolled plans with them in the process of their field work. Plan sheets and especially paper plan sheets deterioriate both in legibility and structural integrity when used in continual subjection to sun, weather, moisture and dirt and in the process of general handling and transporting to and from job site. A system of storing and protecting these plans from outside elements facilitates the longevity of these materials.

Heretofore, a variety of wire, metal, and cardboard plan holders have been implemented for storage of plans in the office and single tubes are offered for storage of plans in the field, but it has been difficult for this party to find an assembly of weather-proof containers to protect, store and transport a number of plan sets conveniently together.

SUMMARY OF THE INVENTION

Objects and Advantages

Accordingly, I claim the following objects and advantages of the invention which will be described subsequently in greater detail; to provide a lightweight, durable, ridgidly connected, weather-proof assembly of tubes for the storage, transportation and protection from outside elements of rolled plans and/or plan sets used for construction or maps, graphs or charts or art work or any item which may be conveniently deposited and withdrawn.

In addition, I claim the following objects and advantages: to provide an assembly of storage tubes whose cover end caps may be easily placed on and removed and whose frame flange plate can be easily bracketed and mounted to walls, posts, and vehicles or anything appropriate and when not mounted may include a handle for ease of carrying. In addition, another option is a flexible retaining line, looped through two eye bolts or applicable means with each item penetrating the cap and flange plate and fastened with double nuts. This is one option of many connection processes.

An assembly of a larger flange plate may also be constructed large enough and as in such a configuration to be placed on the floor of an office and hold as many tubes as desired for objects of choice. Further objects and advantages of the invention will become apparent from a consideration of the drawings and ensueing description of this invention.

BRIEF DESCRIPTION OF THE DRAWINGS:

FIG. 1 shows a perspective, elevational view of one side of the storage tube holder with a solid flange plate on top.

Figure 3A:
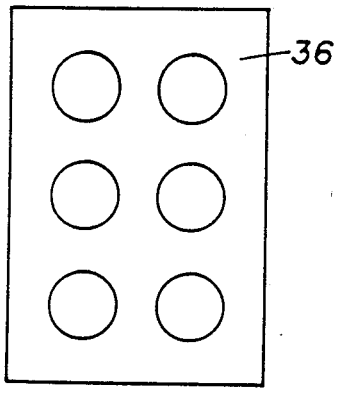

The bottom half of FIG. 1 is the same perspective, elevational view of one side of the storage tube holder with a split flange plate on the bottom, constructed of either plastic, wood, or metal or any possible material and may be completely interchangeable.

FIG. 2 shows a side view cross section of the split flange plate at the center of the bolt, bolt hole and counter sink and applies to all bolts used on this type of flange plate.

FIGS. 3A, 3B, 3C, 3D, 3E, 3F depict possible alternate flange plate configurations. These are shown in plan view. Many other configurations are also conceivable to anyone with a good imagination process. The designs and numbers of tube holes are limitless and endless for this invention.

DRAWING REFERENCE NUMERALS:

6 Removable cap
8 Storage tube
10 Retainer ring
12 Solid flange plate
13 Split flange plate
14 Permanent bottom cap
16 Permanent cap for handle
18 Glued retainer ring for handle
20 Handle
22 Eye bolt
24 Eye bolt nut
26 Retainer cord
28 Vacuum break hole
30 Hole for countersunk bolt
32 Countersunk bolt
34 Countersunk nut

DETAILED DESCRIPTION OF PREFERRED EMBODIMENT:

FIG. 1 shows a perspective, elevational view of one side of the storage tube holder 8 formed of elongated, hollow plastic or metal pipe and flange plates which could be manufactured of plastic, wood, or metal or other appropriate substances according to the preferred embodiment of the invention.

One quarter of the diameter of one of the two identical tubes 8 has been sectioned for clarity. One quarter of the diameter of the top portion of the handle 20 has been sectioned for clarity. Handle may be smaller than actual storage tube. The cap is manufactured to fit firmly over end of tube. The tubes may be of any diameter and length. One material choice for pipe is plastic and for flange plates plastic or wood, but not limited to these except that plastic and wood are easier to cut and connect and generally simpler to work with. There is also a great selection of colors of plastic to choose from, but many materials could be negotiated. The assembly may contain any number of tubes. This drawing shows only two tubes, but any amount may be included within the solid or split flange plates.

This holder can be constructed to set on the floor in any office by enlarging flange plate to accomodate multiple tubes or can be carried to different job sites with the convenient handle assembly 20. This unit may also be attached to a wall of a vehicle, truck bed, wall behind seat of truck, office wall, posts or wherever most convenient with simple "L" brackets or other functional attachment means to protect one's blueprints or plans when an inspector, survey crew chief or foreman needs to transport the plans out to dusty and dirty building sites or may be attached to the interior or exterior bulkhead of a boat for chart storage. There is a removable cap 6 to cover tube holder opening to protect contents from weather conditions or outside elements. This cap 6 is attached to tube by an optional retainer line. Chain, rope or other flexible material may be attached to tube in any length in order not to misplace the cap 6. In this drawing the retainer line 26 is attached to flange plate 12 by an eye bolt 22 and nut 24 assembly. Any type of attachment process is certainly acceptable. The retainer line is attached to the cap 6 by generally the same means.

A tube is cut to required length. The flange plates 12 and 13 have been additionally sectioned at remaining tops and bottoms of tubes to clarify tube, retainer ring and cap connections. The solid flange plate 12 is cut to necessary dimensions depending upon number of tubes 8 used in container. Then a hole is normally drilled perpendicular to surface of the solid flange plate 12 to accomodate a snug fit up insertion of the tube 8 through flange plate. The hole is cut to a dimension as close as possible to the outside diameter of the tube 8 being used to facilitate a snug fit. The solid flange plate 12 and the split flange plate 13 are both equal in dimensions. The split flange plate 13 is cut perpendicular to the surface through the centers of the holder to accomodate pipe clamping. The tubes 8 and 20 in this example, penetrate the flange plates 12 and 13 centered width-wise and equidistant lengthwise from end of both plates 12 and 13.

A pipe coupler is sectioned perpendicular to its axis to make a retainer ring 10. The cap is cut on a plane perpendicular to the radial axis of the cap producing an end cap and retainer ring for sealing of the tube end and retaining of the flange plate respectively. The tube 8 is placed through the holes in the solid flange plate 12 with a retainer ring 10 around the tube 8 on both sides of flange plate 12. Retainer rings 10 and 18 could be eliminated if a split flange plate were to be used. The retainer rings 10 and tube 8 are then glued into place with an appropriate substance. A gluing process was used with this unit, but welding or any means may be used in order to mold or connect pieces together.

Then an end cover cap 14 is glued on end of protruding tube 8. Again, any connecting process which is appropriate may be used.

The smaller tubal handle 20, dowel or rod may be used, is cut to required size and is also placed into position in the solid flange plate 12 with its small retainer rings 18 inside of the flange plate 12 and the cap glued on the pipe on the outside of the solid flange plate 12. Handle 20 may also be made of wood or metal as to interchange plastic and wood for a different appearance.

Figure 3B:
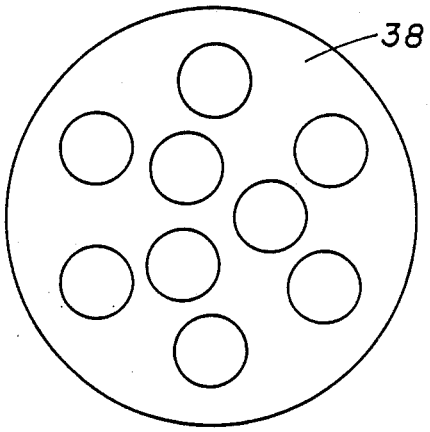
Figure 3D:
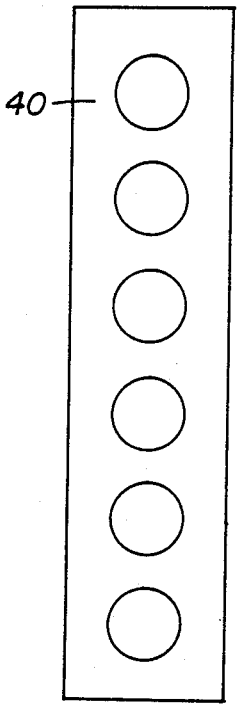
Figure 3D:
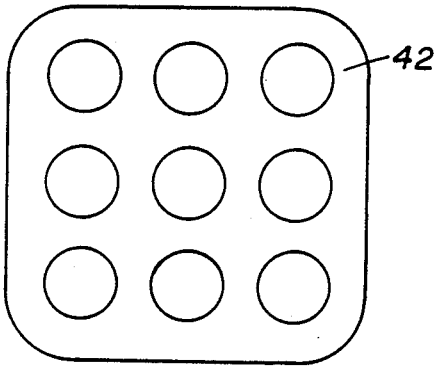
Figure 3E:
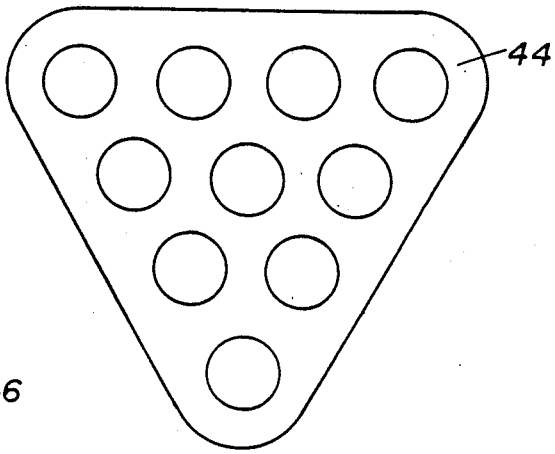
Figure 3F:
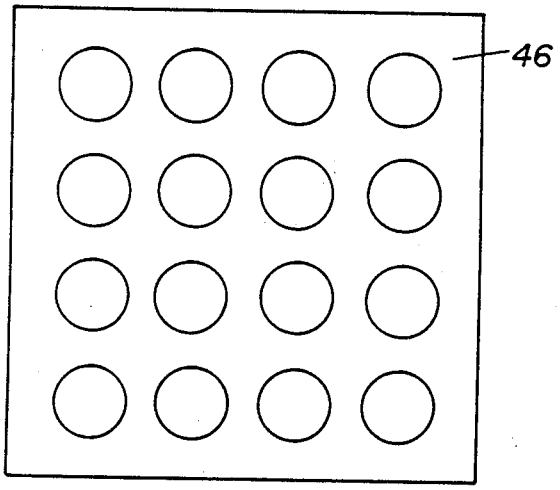

The corners of the solid flange plate 12 or the split flange plate 13 could be rounded off to radii as in sheet 2, FIG. 3B, 3D, and 3E of drawings or be left square cornered or any shape as desired.

Another optional item is hole 28 drilled in the top section of each tube 8 to be used as a vacuum break when cap 6 is pressed on or removed from tube 8. This process may be eliminated if a different means is more functional.

The removeable cover cap 6 and the permanent bottom cap 14 are standard closure caps made of either P.V.C., A.B.S. or styrene plastic manufactured for use with PVC pipe. Again, this covering is not limited to only these materials, but this party found the materials used to be the most convenient.

Appropriate labeling may be placed on the ends of the removeable cover caps 6 in order to identify contents.

The bottom half of FIG. 1 shows an alternate or optional connection process if a split flange plate 13 were to be used. Again, the dimensions and configurations will vary according to desired configurations and number of tubes needed. This process eliminates the requirement for glued retainer rings and also allows for interchangeability of wood or plastic or metal flange plates or any other appropriate materials. But for all intent and purposes of this invention, the drawing indicates the split flange plate 13 with a bolt and nut assembly 32 and 34 with bolt and nut receeded opposite each other width-wise edges of total split flange plate 13 as an alternative attachment process. The possibilities of different clamping processes for this invention are numerous.

FIG. 2 shows a side view cross section of the split flange plate 13 at the center of the bolt 32, bolt hole and counter sink 30 and applies to all bolts in split flange plate 13.

FIGS. 3A, 3B, 3C, 3D, 3E, 3F are alternative designs for flange plates. The possible arrangement variations of alternative designs are limitless and not restricted to any of the configurations and numbers of tubes shown in this invention.

FIGS. 3A, 3C, 3D, and 3F may be designed as split flange plates accomodating bolt and clamp construction. However, FIG. 3A and FIG. 3C would be most practical for this application due to their narrower width.

The corners of FIG. 3D and FIG. 3E have been trimmed to radii suggesting another possible flange plate design alternative.

CONCLUSION AND SCOPE OF INVENTION:

While the above description contains many specifications, the reader should not construe these as limitations on the scope of the invention, but merely as exemplifications of preferred embodiments thereof. Those skilled in the art will envision that many other possible variations and configurations are within its scope. For example, skilled artisans will readily be able to change the dimensions and shapes of the various flange plate embodiments. They will also be able to make the tube holder of alternative materials. They can make many variations in numbers of tubes placed in the tubal storage holder design of FIG. 1 and use different colors of materials. The flange plate may be manufactured to accommodate tubes three square, nine tubes in all or any number. An "L" bracket or any desired attachment process may be mounted to flange plate and attached to the wall behind the seat of a pick up truck or the wall of the side panel in the bed of the pick up truck, or office wall, posts, boat bulkhead or attached wherever most convenient. The flange plate may be made large enough to accommodate multiple tubes to set on the floor of an office in order to maintain their rolled plan sheets in an orderly, clean, and very organized fashion.

Accordingly, the reader is requested to determine the scope of the invention by the appended claims and their legal equivalents, and not by the examples which have been given in this patent application.

I claim:

1. A device to segregate, store and carry a plurality of distinct articles, comprising, in combination:

a plurality of storage tubes having top and bottom open ends, spaced top and bottom flange plate members, each said flange plate member has a plurality of holes, said storage tubes extending between said spaced top and bottom flange plate members and through said holes to constrain said tubes in an array such that each said tube is held in fixed relation with respect to all of said tubes, said tubes having end portions which project beyond said flange plate members, a plurality of bottom end caps, said bottom end caps attached to said bottom ends, one cap per bottom end and located substantially adjacent said bottom flange plate members thereby sealing said bottom end, a plurality of top end removable caps dimensioned to fit on said top end, one for each said top end to thereby selectively expose or occlude interiors of said tubes and a plurality of retaining ring means attached on each said top end adjacent, abutting and fixing said top flange plate member to each said tube.

2. The device of claim 1 including handle means extending between said flanges to facilitate transport of said device.

3. The device of claim 2 wherein said handle means includes an elongate cylindrical shaft having portions which project beyond said flanges, each said portion contained with a handle cap, whereby said shaft can be conveniently and efficiently grasped anywhere along its length between said flanges.

4. The device of claim 3 wherein said top end removable caps are tethered to said flange which is adjacent said top end by means of a retainer tether interposed between said removable cap and said flange.

5. The device of claim 4 wherein said tether is configured as a retainer cord.

6. The device of claim 5 wherein said tether attaches to said cap and said flange by means of eyebolts extending through said flange plate and affixed thereto and through said removable cap and affixed thereto.

7. The device of claim 6 including a vent hole in each tube to preclude formation of a vacuum when opening the tube.

* * * * *